United States Patent [19]

Hasegawa

[11] 4,388,365

[45] Jun. 14, 1983

[54] POROUS FRP SHEET AND MANUFACTURING METHOD THEREOF

[75] Inventor: Shigekazu Hasegawa, Yachiyo, Japan

[73] Assignee: Hawegawa Chemical Industry Co., Ltd., Yachiyo, Japan

[21] Appl. No.: 351,038

[22] Filed: Feb. 22, 1982

[30] Foreign Application Priority Data

Mar. 20, 1981 [JP] Japan ..... 56-41243

[51] Int. Cl.[3] ..... B32B 7/00

[52] U.S. Cl. ..... 428/258; 28/169; 427/173; 427/175; 427/176; 428/257; 428/259

[58] Field of Search ..... 428/257, 258, 259; 28/169; 427/173, 175, 176

[56] References Cited

U.S. PATENT DOCUMENTS 4,105,495 8/1978 Pai ..... 428/259

4,282,011 8/1981 Terpay ..... 428/259

*Primary Examiner*—James J. Bell

*Attorney, Agent, or Firm*—Brumbaugh, Graves, Donohue & Raymond

[57] ABSTRACT

According to the present invention, a porous FRP sheet can be easily manufactured without need for the punching or drilling process which is required in conventional prior methods for manufacturing an FRP sheet. The FRP sheet manufactured by the present method has superior reinforcing characteristics, since the reinforcing fibers composing the FRP sheet are not cut but are retained in continuous condition.

2 Claims, 3 Drawing Figures

POROUS FRP SHEET AND MANUFACTURING METHOD THEREOF

The present invention relates to an FRP sheet and a manufacturing method thereof, more specifically, an FRP sheet having numerous pores formed by impregnating woven fabric (cloth) with thermosetting resin and curing it.

FRP sheets are used as core material to reinforce various resin moldings. For example, in making a plastic ski, FRP sheet is used as the core to reinforce strength of expandable polyurethane.

FRP sheets used as the core of expandable resin should be abundantly perforated so as not to prevent vesicating of resin. Therefore, in case of conventional FRP sheet, a number of pores are made by punching or drilling them before they have been formed. To perform such work on FRP sheet, however, raises its production costs to a great extent and also weakens the reinforcing characteristics due to the cutting of reinforcing fiber.

There also is a method to form a porous FRP sheet from an FRP sheet made of clothform reinforcing fiber. In this method, the cloth itself is woven coarsely with a reduced number of warps and/or wefts, and it is impregnated with resin and cured. According to this method, as the number of warps and/or wefts composing the cloth have to be reduced, it is difficult to increasing the reinforcing characteristics of the FRP sheet.

Another conventional method is a "screen weaving" of glass fiber. In this method, glass roving and fine, twisted glass thread are arranged alternately as warps, and weft is run through the fine twisted thread group and the roving group. According to this method, either thread is woven without specific application of tension. The fine twisted thread being finer than the roving and having large elasticity because of its being twisted, when a same degree of tension is applied to both, the roving becomes almost straight while the fine twisted thread is bent by weft and curves upward and downward against the roving. Consequently, the weft acts rather to press the roving whereas the roving stretches bilaterally becaust it is not twisted, resulting in no openings (pores) between the twisted thread and the roving.

Accordingly, an object of the present invention is to provide an FRP sheet which has numerous pores formed all over its surface simultaneously with its formation without secondary processes such as punching or drilling being performed on it, and a manufacturing method thereof.

Another object of the present invention is to provide an FRP sheet which has numerous pores formed all over its surface without specific reduction of the wedging numbers of warps and wefts composing the cloth, and a manufacturing method thereof.

FIG. 3(2) shows the roving tightly wrapped in weft so as to be rounded by the latter.

The invention will be described further referring to accompanying drawings.

Figure 1:
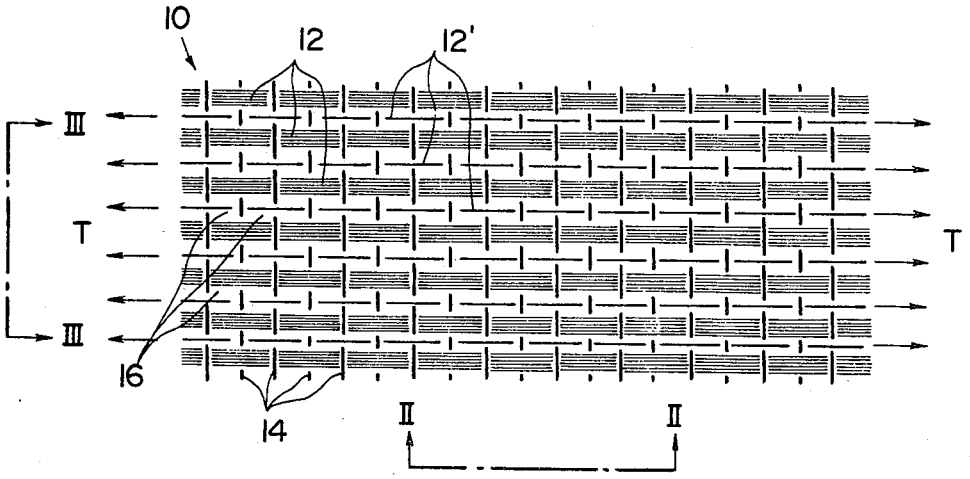
FIG. 1 is a clothform reinforcing body woven with the method according to the present invention.

FIG. 1 shows a clothform (woven fabric) reinforcing body 10 of an FRP sheet according to the present invention, specifically a state wherein tension is applied to one kind of warp (such as twisted thread 12'). Since the FRP sheet according to the present invention is the one made of warps 12, 12' and weft 14 of the clothform reinforcing body 10 shown in FIG. 1 being impregnated with thermosetting resin and cured, an illustration of its external shape is substantially identical with the clothform reinforcing body 10 of FIG. 1. Therefore, no illustration of the FRP sheet is given here.

The clothform reinforcing body 10 comprises warps 12, 12' and weft 14. The warp 12 is made of roving (roving means long, untwisted fibers put together into a bundle, but in this case it includes slightly twisted fibers) of high tension-resistant fiber such as glass fiber, carbon fiber or KEVLAR fiber. The other warp 12' is eighter thread made of twisted high tension-resistant fiber as mentioned above or any appropriate metal thread. In the present invention, it is not necessary to pay special attention to weft 14 and it can be selected from a variety of threads.

FIG. 1 shows a reinforcing body 10 wherein one kind of warp, i.e., roving 12 and the other warp, i.e., twisted thread or metal thread (hereinafter called twisted thread) 12' are arranged alternately. However, it is apparent that other arrangements are possible to appropriate combinations of a plural number of rovings 12 and a plural number of twisted threads 12', and also weft 14 can be composed of combinations of different kinds of threads.

The present invention is characterized in that tension T is applied to the twisted thread 12' of the reinforcing body 10 structured as mentioned above, and the reinforcing body 10 is impregnated and cured as it is kept in that state.

Figure 2:
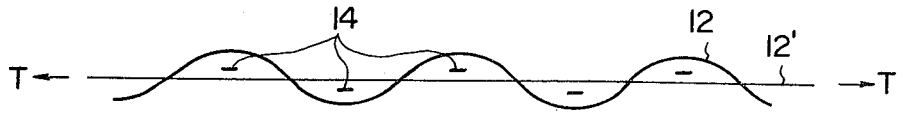
FIG. 2 shows one kind of warp (roving) being thickened vertically and becoming three-dimensional when tension is applied to the other kind of warp (twisted thread)

When tension T is applied to the twisted thread 12', it gets "strained" against the roving 12. As a result, roving 12 is put in a state of bending upward and downward (FIG. 2). Accordingly, when tension is being applied to its twisted thread 12', the cloth, i.e., the reinforcing body 10 becomes thicker vertically (in the direction of thickness) than when tension T is not applied to the twisted thread 12', and its plane shape acquires three-dimensionality to some extent. This process to make it three-dimensional is the first important cause for exercising an effect on formation of numerous pores 16 in the cloth, i.e., the reinforcing body 10 (FIG. 1).

On the other hand, when tension T is applied to the twisted thread 12', the weft 14 crossing the twisted thread 12' gives way to the twisted thread 12' in the crossing section. This results in bending and strong tensioning of the weft 14 at the same time.

Figure 3:
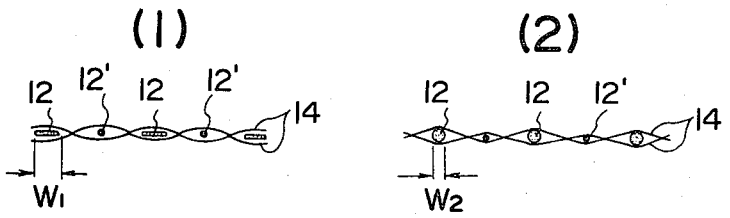
FIG. 3(1) shows the roving loosely wrapped in weft.

FIG. 3 illustrates the state described in the preceding paragraph. FIG. 3(1) shows the relation between the weft 14 and the roving 12 when tension T is not applied to the twisted thread 12'. In this case, since the roving 12 is just loosely wrapped in the weft 14, it is in a state of being flat and slack (width $W_1$). On the contrary, as shown in FIG. 3(2), when tension T is applied to the twisted thread 12', the weft 14 bends and simultaneously is strongly pulled as mentioned above so that the roving 12 is pressed from both sides of the weft 14 and gets rounded. As a matter of course, the width $W_2$ of the roving 12 in this rounded condition is less than $W_1$ of the roving shown in FIG. 3(1). Consequently, openings between adjoining rovings 12 are widened. This is the second cause for exercising an effect on formation of numerous pores 16 in the cloth, i.e., the reinforcing body.

As described above, according to the present invention, by applying tension T to the twisted thread 12', the roving bends upward and downward and gains a thickness so as to get somewhat three-dimensional. Furthermore, the roving 12 that characteristically tends to be slack is rounded by the weft 14. By these two processes, numerous pores 16 are formed in the cloth at a time. Therefore, if the cloth is impregnated in this condition with thermosetting resin and cured, an FRP sheet with numerous pores 16 can be easily obtained. According to the present invention, an FRP sheet with numerous pores 16 can be easily manufactured without need for a punching or drilling process which would lower the reinforcing characteristics of the reinforcing fiber.

If the FRP sheet formed as mentioned above is used for reinforcing a member (for example, an ornamental board or the sliding board of a ski) by spot-bonding beforehand, the manufacturing process of the expanded urethane ski will be simplized.

What is claimed is:

1. A porous FRP (Fiber Reinforced Plastics) sheet containing a woven fabric reinforcing body formed by warp and weft impregnated with cured thermosetting resin, the warp consisting of roving and thread selected from the group consisting of twisted thread or metal thread, the roving being bent above and below the weft, wherein tension is applied to the twisted or metal thread in the warp so as to affect the tension to the weft so that the roving is rounded and wrapped by the tensed weft.

2. A method of manufacturing a porous FRP (Fiber Reinforcing Plastics) sheet comprising:

(a) forming a woven fabric reinforcing body by weft and warp consisting of roving and thread selected from the group consisting of twisted thread or metal thread, the roving being bent above and below the weft;

(b) applying tension to the twisted or metal threads of the warp so as to affect the tension to the weft so that the roving is rounded and wrapped by the tensed weft;

(c) impregnating the resulting woven fabric reinforcing body with thermosetting resin; and (d) curing the resin on the impregnated woven fabric reinforcing body.

* * * * *

UNITED STATES PATENT AND TRADEMARK OFFICE

CERTIFICATE OF CORRECTION

PATENT NO. : 4,388,365

DATED : June 14, 1983

INVENTOR(S) : Shigekazu Hasegawa

It is certified that error appears in the above—identified patent and that said Letters Patent is hereby corrected as shown below:

First page, Item 73, "Hawegawa" should read --Hasegawa--;
Column 1, line 44, "becaust" should read --because--;
Column 2, line 63, "of" should read --by--.

Signed and Sealed this

*Twenty-sixth* Day of *June 1984*

[SEAL]

*Attest:*

GERALD J. MOSSINGHOFF

*Attesting Officer*

*Commissioner of Patents and Trademarks*